United States Patent [19]

Orav

[11] Patent Number: 4,596,393

[45] Date of Patent: Jun. 24, 1986

[54] ANTI-BOUNCE-BACK DART

[76] Inventor: Mihkel Orav, 442 Clearview Dr., Unit O, Euclid, Ohio 44123

[21] Appl. No.: 789,828

[22] Filed: Oct. 21, 1985

[51] Int. Cl.[4] ..... A63B 65/02

[52] U.S. Cl. ..... 273/420

[58] Field of Search ..... 273/419, 420

[56] References Cited

U.S. PATENT DOCUMENTS 4,478,421 10/1984 Michalicka et al. ..... 273/420

FOREIGN PATENT DOCUMENTS 1538983 1/1979 United Kingdom ..... 273/419

1593047 7/1981 United Kingdom ..... 273/420

*Primary Examiner*—Paul E. Shapiro

*Attorney, Agent, or Firm*—Howard D. Gordon

[57] ABSTRACT

A game dart (10) of the anti-bounce-back type is provided for use with a dartboard (10A) having rib wires (13, 14). The game dart includes a body section (20), a point section (22) axially movable in the body section and a tail section (24) fixed to the body section and carrying flight members (26). The connection (48, 50) between the point and body sections is configured to cause simultaneous relative rotational and axial movement therebetween.

14 Claims, 5 Drawing Figures

ANTI-BOUNCE-BACK DART

BACKGROUND OF THE INVENTION

1. Field of the Invention

This invention relates to game darts utilized with dart boards divided into sections by wires and particularly to game darts having means to minimize or eliminate the occurrence of dart bounce-back resulting from the tip striking a wire. More particularly, the present invention relates to anti-bounce-back game darts having a point section mounted for both axial and rotational simultaneous movement relative to the body or barrel section.

2. Description of the Prior Art

The game of darts is played throughout the world as a competitive contest. Many players are quite skilled in throwing a dart at a designated or desired location on a dartboard. The dartboards employed by serious players of the game incorporate a plurality of metal ribs to define target patterns for the board; and many games of darts require the participants to hit within predetermined target areas whose boundaries are defined by the metal ribs. As such, the ribs are fabricated from steel wire of a diameter between one or two or more millimeters. As will be described, the total area covered by these ribs is a reasonable portion of the board area. Hence, players often times hit a metal rib with the dart point. This causes the dart to bounce off the board and hence, the player receives no score. It is also determined that the better the player is, the more bounce-off he will experience due to the object and formats of various dart contests or games.

Various anti-bounce-off or anti-bounce-back game darts are known in the prior art. These include two general types of darts, darts utilizing point sections axially movably mounted in the body sections as seen in U.S. Pat. Nos. 4,109,915; 4,181,303 and 4,230,322, and darts utilizing point sections resiliently pivotably mounted in body sections as seen in U.S. Pat. No. 4,101,126.

While the prior art anti-bounce-back darts are generally improvements over darts having point sections rigidly mounted in the body sections, the prior art devices were not totally satisfactory as the devices were complicated and/or expensive to produce and/or required biasing springs, drag fittings or resilient coupling and/or did not minimize the bounce-back occurrence to an acceptably low level.

SUMMARY OF THE INVENTION

In accordance with the present invention, the drawbacks of the prior art have been overcome, or minimized, by the provision of a relatively simple, inexpensively produced anti-bounce-back game dart which requires no resilient fittings, biasing springs nor resilient connections and which minimizes the occurrence of bounce-back to a lower level than heretofore obtainable.

The above is accomplished by providing a game dart wherein the point section is mounted for simultaneous axial and rotational movement relative to the body or barrel section. In a preferred embodiment, the point section and body section are connected by a pin or pins extending from either the point or body section which is received in an axially extending generally helical groove provided in the other of the point or body sections such that axial movement of the point section relative to the body section will result in simultaneous rotation of the point section relative to the body section.

In use, the point section is moved to its most axially extended position relative to the body section and the game dart is thrown toward the dartboard. Should a wire be struck by the dart tip, the point is forced axially inwardly into the body section, causing a rotation of the point section which has been found to minimize the occurrence of bounce-back. It is believed that the rotation of the point tip relative to the struck wire will result in the point tip "walking off" the wire and proceeding into the adjacent dartboard body.

By properly sizing the body and the point sections, the relative lack of rotation of the body section and positive rotation of the tip relative to wire may be assured. By proper selection of the helical groove lead angle, the need for resilient biasing devices is eliminated and a desirable resistance to relative axial movement between the point and body portions is provided.

Accordingly, it is an object of the present invention to provide a new and improved anti-bounce-back game dart.

This and other objects and advantages of the present inventions will become apparent from a reading of the description of the preferred embodiment of the present invention taken in connection with the attached drawings.

DESCRIPTION OF THE PREFERRED EMBODIMENT

In the following description of the preferred embodiment, certain terminology will be utilized for purposes of reference only and are not intended to be limiting. For example, the terms "forward" and "rearward" will refer to the direction in which a dart is normally thrown. The terms "inward", and "outward" will refer to directions towards and away from, respectively, the geometric center of the device being described. The above applies to the terms specifically mentioned above and to words of similar inport.

Figure 1:
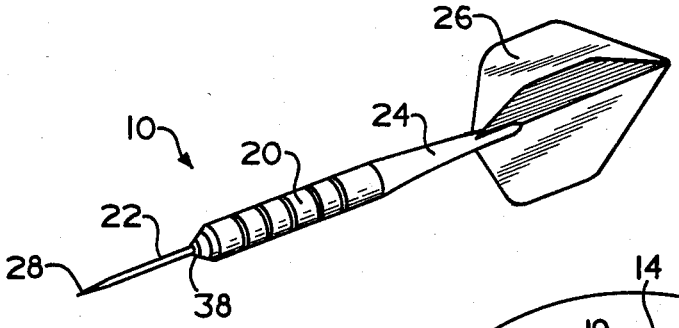
FIG. 1 is a perspective view of the game dart of the present invention.
Figure 1A:
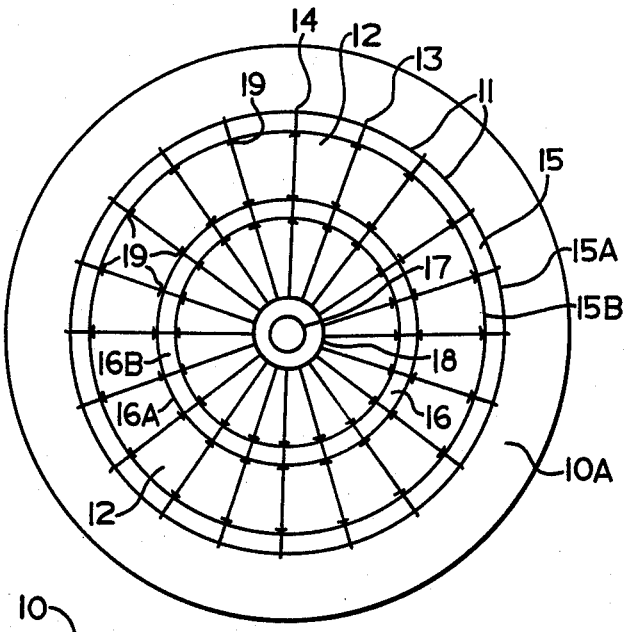
FIG. 1A is a front view of a typical dartboard.

The game dart 10 of the present invention, and a typical dartboard 10A used therewith, are illustrated in FIGS. 1 and 1A, respectively.

Referring to FIG. 1A, there is shown a typical tournament type of dartboard 10A. Such boards as 10A are constructed from a penetrable material such as jute, cork and so on to permit a pointed dart to enter the board and be held in place by the board material. The operation of a dart and dartboard is considered to be well known. The dartboard 10A is usually about forty or more centimeters in diameter and has a plurality of metal ribs 11 defining target patters.

Essentially, the board 10A contains twenty equal pie-shaped areas as 12. Each area as 12 is bounded by two radial metal ribs as 13 and 14. Each rib 13 and 14 is approximately 1 to 2 or more millimeters in diameter and is fabricated from a steel wire of a circular cross-section. An outer ring area 15 is located about sixteen centimeters from the center of the board. The outer ring area 15 is defined by an outermost metal rib 15A and an inner rib 15B. The distance between the ribs 15A and 15B is approximately one centimeter.

An inner ring area 16 is located about ten centimeters from the center and is defined by an outer ring 16A and an inner ring 16B. The distance between the rings 16A and 16B or the inner area 16 between the rings is also about one centimeter.

There is a central bulls-eye area 17 and a concentric area 18. Area 17 is about one and a half centimeters in diameter with area 18 about three and a half centimeters in diameter. The entire metal grid is held in place on the board 10A by a series of staples as 19 which are of the same material as the wire grids. It is thus indicated that in a board as 10A, the entire grid depicted is formed by steel wire of approximately 1 to 2 millimeters in diameter and a circular cross-section.

As can be ascertained, the wire grid depicted covers a reasonable portion of the board 10A. If a player, upon throwing a conventional dart, strikes a metal grid wire 11, the dart bounces off and does not secure itself in the board 10A. For the bounce-off the player receives no score. Furthermore, the point of the dart may be damaged by striking the metal grid wires.

The anti-bounce-back game dart 10 of the present invention includes a body or barrel section 20, a point section 22 extending axially from the body section 20 and a tail section 24 which carries the flight elements 26 which may be separable or integral with the tail section. The free end of point section 22 is provided with a tapered pointed tip 28 for penetration of a target such as dartboard 10A.

Game darts and dartboards of this general type, and the games played therewith, are well known in the prior art and may be appreciated by reference to U.S. Pat. Nos. 4,101,126; 4,109,915; 4,181,303 and 4,230,322, the disclosures of which are hereby incorporated by reference herein.

Figure 2:
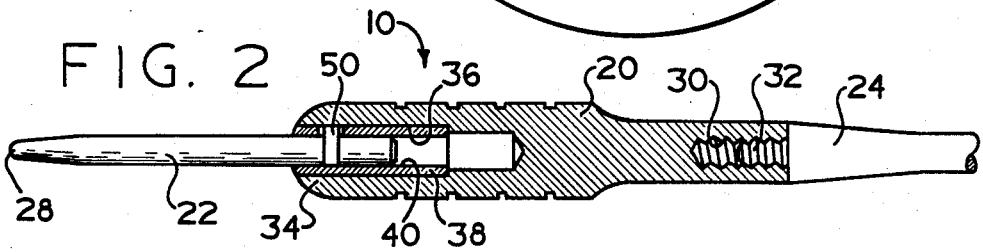
FIG. 2 is an enlarged partial sectional view of the game dart of FIG. 1.
Figure 3:
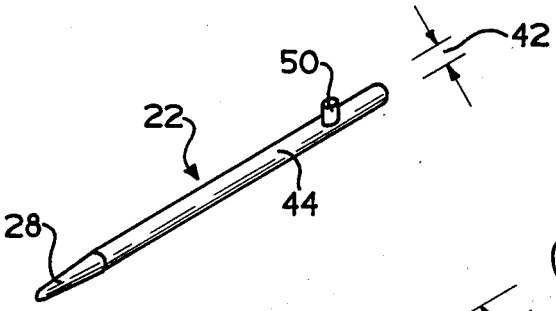
FIG. 3 is a perspective view of the point section of the game dart of the present invention.
Figure 4:
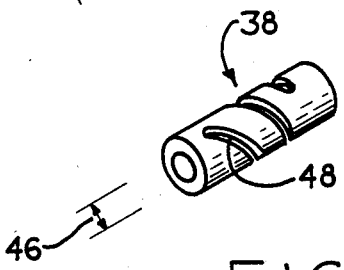
FIG. 4 is a perspective view of a helically grooved sleeve section utilized with the dart of FIG. 1.

The detailed construction and operation of the anti-bounce-back game dart 10 of the present invention may be seen by reference to FIGS. 2–4.

Typically, body section 20 is a machined metallic part, usually of a stainless steel, having an internally threaded bore 30 at one end, the rearward end 31, thereof for threaded receipt of a complimentary threaded portion 32 of the tail section 24. The forward end 34 of the body section is provided with a forwardly opening cavity or bore 36. Preferably, a grooved sleeve 38 is fixedly received in cavity 36. It is understood, however, that a spiral groove could be provided directly in the inner diameter surface of bore 36.

Point section 22 is slidably received within the inner diameter bore 40 of sleeve 38. The outer diameter 42 of the shaft portion 44 of the point section 22 is smaller than the inner diameter 46 of bore 40. Sleeve 38 is provided with an axially extending spiral or helical groove 48 for sliding receipt of a pin 50 extending radially outwardly from the shaft portion 44 of the point section. It is understood that various modifications, such as providing multiple pins 50, providing the grooves on the outer surface of the shaft portion 44 and fixing the pin to the body portion, and the like, are possible to provide a connection wherein relative axial movement between the pin and body portions will cause simultaneous relative rotational movement therebetween.

In operation, the point section is moved axially forward relative to body section to its most axially extended position as illustrated in FIG. 2. The game dart 10 is then thrown at the dartboard 10A. If the tip 28 of point section 22 strikes a rib wire, the relative greater mass of the body portion will force the point portion axially inwardly into cavity 36 which will cause the tip 28 of the point section to rotate relative to the wire and body section causing the tip to rotate off the wire and penetrate an adjacent portion of the dartboard.

It is important to size the relative masses and inertias of the body and point section such that upon a tip 28 striking a wire the body section (20) and tail section (24) assembly and the wire will experience relatively little or no relative rotation and the point section will rotate relative to the wire. By selecting a proper lead angle or lead of groove 48, the point section 22 will maintain its axial position relative to body section 20 without the need for resilient biasing or resilient drag device. It has been found that a lead of about two to five revolutions per inch, preferably about four revolutions per inch, is satisfactory.

To verify the improved performance of the game darts of the present invention, various tests have been carried out with darts of equal weights but different point characteristics. Each dart was thrown five hundred times at a special test dartboard from an eight foot distance. The test board consisted of an eighteen inch diameter bristle base with a number of wires, arranged in a grid form, on the base. The vertical wires of the grid were spaced 0.1875 inch apart and had a diameter of 0.056 inch. The horizontal wires of the grid were spaced 0.4375 inch apart and had a diameter of 0.56 inch. The wires were held in place by staples 0.056 inch in diameter, spaced approximately 1.0 inch apart.

TABLE

| Test Number | No. of Darts Thrown | Dart Weight (Grams) | Movement of Point | Rebound Frequency |
|---|---|---|---|---|
| 1 | 500 | 24 | None | 5.4% |
| 2 | 500 | 24 | Axial Only (3/16 in. movement) | 2.6% |
| 3 | 500 | 24 | Axial & Rotational | .4% |

The above tests were conducted by the same individual. It has been observed that the frequency of bounce-outs is further dependent on two additional factors - how hard the dart is thrown and the weight of the darts used.

It is understood that changes may be made in the construction and/or arrangements of the various parts of the subject invention without departing from the spirit and the scope of the invention as hereinafter claimed.

I claim:

1. A game dart (10) of the type comprising a body section (20) and a point section (22) coupled to the body section for relative axial movement therebetween from a first relative axial position wherein said point section has a maximum axial extension from said body section to a second relative axial position wherein said point section has a minimum axial extension from said body section, said game dart adapted to be thrown at a target (10A) comprising first areas (12) penetrable by said point section and second areas (11, 13, 14) relatively inpenetrable by said point section, said game dart characterized by:

coupling means (48, 50) coupling said point section and body section for simultaneous relative axial and rotational movement therebetween.

2. The game dart (10) of claim 1 further comprising a tail section (24) carrying a plurality of flight members (26) fixed to said body section (20).

3. The game dart (10) of claim 2, wherein said point section (22) is of substantially less mass and inertia than the combined mass and inertia of said body (20) and tail (24) sections whereby the striking of one of said relatively inpenetrably areas (11, 13, 14) by said point section will cause said point section to be moved axially relative to said body section toward said second relative axial position and said body and tail sections will experience relatively little rotation relative to said target and said point section to rotate relative to said relatively inpenetrable area.

4. The game dart (10) of claim 3, wherein the forward end (34) of said body section (20) defines a forwardly opening cavity (36) in which the shaft portion (44) of the point section (22) is axially slidably received, said coupling means comprising a pin member (50) extending radially from one of said inner diameter surface (40) of said cavity and other surface of said shaft portion towards an axially extending generally helical groove (50) formed in the other of said inner diameter surface and outer surface for sliding receipt therein.

5. The game dart (10) of claim 4 wherein said pin member (50) extends from said outer surface of said shaft portion (44).

6. The game dart (10) of claim 5, wherein said helical groove (48) is formed in an insert (38) fixed in said cavity.

7. The game dart (10) of claim 4, wherein the lead angle of said groove is selected so that said point section in said first relative axial position will remain in said first relative axial position in the absence of said point section contacting a relatively solid object.

8. The game dart (10) of claim 5, wherein the lead angle of said groove is selected so that said point section in said first relative axial position will remain in said first relative axial position in the absence of said point section contacting a relatively solid object.

9. The game dart (10) of claim 2, wherein the forward end (34) of said body section (20) defines a forwardly opening cavity (36) in which the shaft portion (44) of the point section (22) is axially slidably received, said coupling means comprising a pin member (50) extending radially from one of said inner diameter surface (40) of said cavity and other surface of said shaft portion towards an axially extending generally helical groove (50) formed in the other of said inner diameter surface and outer surface for sliding receipt therein.

10. The game dart (10) of claim 1, wherein the forward end (34) of said body section (20) defines a forwardly opening cavity (36) in which the shaft portion (44) of the point section (22) is axially slidably received, said coupling means comprising a pin member (50) extending radially from one of said inner diameter surface (40) of said cavity and other surface of said shaft portion towards an axially extending generally helical groove (50) formed in the other of said inner diameter surface and outer surface for sliding receipt therein.

11. The game dart (10) of claim 10 wherein said pin member (50) extends from said outer surface of said shaft portion (44).

12. The game dart (10) of claim 11, wherein said helical groove (48) is formed in an insert (38) fixed in said cavity.

13. The game dart (10) of claim 10, wherein the lead angle of said groove is selected so that said point section in said first relative axial position will remain in said first relative axial position in the absence of said point section contacting a relatively solid object.

14. The game dart (10) of claim 11, wherein the lead angle of said groove is selected so that said point section in said first relative axial position will remain in said first relative axial position in the absence of said point section contacting a relatively solid object.

* * * * *